US009032883B2

(12) United States Patent
Roy et al.

(10) Patent No.: US 9,032,883 B2
(45) Date of Patent: May 19, 2015

(54) FOLDABLE TABLE

(71) Applicant: MEGA Brands Inc., Montreal (CA)

(72) Inventors: Dominique Roy, St-Lazare (CA); Thierry Beauregard, Boisbriand (CA)

(73) Assignee: MEGA Brands Inc., Montreal, Quebec (CA)

( * ) Notice: Subject to any disclaimer, the term of this patent is extended or adjusted under 35 U.S.C. 154(b) by 102 days.

(21) Appl. No.: 13/960,001

(22) Filed: Aug. 6, 2013

(65) Prior Publication Data

US 2014/0158023 A1 Jun. 12, 2014

Related U.S. Application Data

(63) Continuation of application No. 12/691,249, filed on Jan. 21, 2010, now Pat. No. 8,528,489.

(60) Provisional application No. 61/147,298, filed on Jan. 26, 2009.

(51) Int. Cl.

| | |
|---|---|
| ***A47B 85/00*** | (2006.01) |
| ***A47B 3/08*** | (2006.01) |
| ***A47B 13/16*** | (2006.01) |
| ***A47D 3/00*** | (2006.01) |

(Continued)

(52) U.S. Cl.

CPC . *A47B 3/08* (2013.01); *A47B 13/16* (2013.01); *A47B 2003/0821* (2013.01); *A47D 3/00* (2013.01); *A47B 3/06* (2013.01); *A47B 13/08* (2013.01)

(58) Field of Classification Search

CPC ..... A47B 13/16; A47B 2003/0821

USPC ..... 108/13, 14, 126, 129, 132, 133, 125, 108/169, 131, 25, 26; 248/188, 439, 168, 248/166; 403/65, 73, 86, 92, 93, 94, 95, 96, 403/98, 150, 151

See application file for complete search history.

(56) References Cited

U.S. PATENT DOCUMENTS

| | | | |
|---|---|---|---|
| 875,195 | A | 12/1907 | Loftin |
| 1,309,774 | A | 7/1919 | Otte |
| 1,959,725 | A | 5/1934 | Lindsay |

(Continued)

FOREIGN PATENT DOCUMENTS

| | | |
|---|---|---|
| CN | 2290241 | 9/1998 |
| DE | 29501774 | 4/1995 |

(Continued)

OTHER PUBLICATIONS

National Phase Claims filed Aug. 26, 2011 in European Patent Application No. 10706355.4.

(Continued)

*Primary Examiner* — Daniel J Troy
*Assistant Examiner* — Andres F Gallego
(74) *Attorney, Agent, or Firm* — Plumsea Law Group, LLC

(57) ABSTRACT

A foldable table that provides a stable operational position in which the table legs may extend beyond the footprint of the table, and a folded, storage position in which the table legs may be tucked within the footprint of the table. An aspect provides table legs that may slide and pivot within sockets of a table top, to enable the legs to lock into the extended position and to also pivot flat against a horizontal undersurface of the table top.

20 Claims, 14 Drawing Sheets

(51) Int. Cl.
*A47B 3/06* (2006.01)
*A47B 13/08* (2006.01)

(56) References Cited

U.S. PATENT DOCUMENTS

| | | | | |
|---|---|---|---|---|
| 2,202,318 | A | | 5/1940 | Ralson |
| 2,558,915 | A | | 7/1951 | Sheffer |
| 2,700,587 | A | | 1/1955 | Godfrey |
| 2,805,707 | A | | 9/1957 | Schoeppner |
| 2,869,769 | A | | 1/1959 | Robinson |
| 2,879,119 | A | | 3/1959 | Bullock |
| 2,903,312 | A | | 9/1959 | Lawless |
| 3,049,825 | A | | 8/1962 | Boyd |
| 3,073,057 | A | | 1/1963 | Farber |
| 3,391,765 | A | | 7/1968 | Baker |
| 3,652,051 | A | | 3/1972 | McFarlane |
| 4,049,091 | A | | 9/1977 | Chubb |
| 4,065,195 | A | | 12/1977 | Fahmie |
| 4,127,948 | A | | 12/1978 | Goy Yu Chin et al. |
| 4,311,099 | A | | 1/1982 | Roberts |
| 4,312,507 | A | | 1/1982 | Smith et al. |
| 4,383,488 | A | | 5/1983 | Macho et al. |
| 4,427,391 | A | | 1/1984 | Berman |
| 4,513,974 | A | | 4/1985 | Lin |
| D282,218 | S | | 1/1986 | Catelli |
| 4,605,099 | A | | 8/1986 | Crum et al. |
| 4,645,162 | A | | 2/1987 | Roy et al. |
| 4,872,410 | A | | 10/1989 | Lilly |
| 4,887,536 | A | | 12/1989 | Teichner |
| 4,907,770 | A | | 3/1990 | Marchetti |
| 4,926,758 | A | | 5/1990 | Lilly et al. |
| 4,930,628 | A | | 6/1990 | Bridges |
| D318,960 | S | | 8/1991 | Lilly et al. |
| 5,038,688 | A | | 8/1991 | Permenter |
| 5,055,081 | A | | 10/1991 | Nayak |
| 5,081,936 | A | | 1/1992 | Drieling |
| 5,161,797 | A | * | 11/1992 | Frasca ..... 473/29 |
| 5,185,892 | A | | 2/1993 | Mitchell |
| 5,218,912 | A | | 6/1993 | Buske |
| 5,244,271 | A | | 9/1993 | Hackwood et al. |
| D342,170 | S | | 12/1993 | Palmer |
| 5,327,838 | A | | 7/1994 | Beltman |
| D350,247 | S | | 9/1994 | Buske |
| 5,360,264 | A | | 11/1994 | Crane |
| 5,377,860 | A | | 1/1995 | Littlejohn et al. |
| 5,383,411 | A | | 1/1995 | Tomaka et al. |
| 5,407,038 | A | | 4/1995 | Pedlar |
| D358,511 | S | | 5/1995 | Frahm |
| D363,663 | S | | 10/1995 | Plater |
| 5,479,866 | A | | 1/1996 | Rae |
| 5,489,144 | A | | 2/1996 | Lewis |
| 5,556,181 | A | | 9/1996 | Bertrand |
| 5,598,786 | A | | 2/1997 | Patterson |
| D385,126 | S | | 10/1997 | Howland et al. |
| 5,680,973 | A | | 10/1997 | Vulpitta et al. |
| D390,718 | S | | 2/1998 | Howland et al. |
| 5,730,066 | A | | 3/1998 | Auten et al. |
| 5,782,185 | A | | 7/1998 | Frahm et al. |
| 5,794,540 | A | | 8/1998 | Dombrowski et al. |
| 5,839,706 | A | | 11/1998 | Liu |
| D404,219 | S | | 1/1999 | Patterson |
| D413,209 | S | | 8/1999 | Jarke |
| D423,345 | S | | 4/2000 | Sugarman |
| 6,044,758 | A | | 4/2000 | Drake |
| 6,050,200 | A | | 4/2000 | Sullins et al. |
| 6,152,417 | A | | 11/2000 | Randall |
| 6,164,213 | A | | 12/2000 | Topps et al. |
| 6,164,484 | A | | 12/2000 | Fiore et al. |
| 6,170,405 | B1 | | 1/2001 | Weitzman et al. |
| 6,173,656 | B1 | | 1/2001 | Blanchard |
| 6,190,082 | B1 | | 2/2001 | Butterfield |
| D455,025 | S | | 4/2002 | Weitzman et al. |
| 6,460,716 | B1 | | 10/2002 | Wong |
| 6,568,506 | B1 | | 5/2003 | Donnalley |
| 6,629,620 | B1 | | 10/2003 | Freeman |
| 6,662,732 | B2 | | 12/2003 | Birsel et al. |
| 6,729,685 | B1 | | 5/2004 | Ebalobor |
| D495,249 | S | | 8/2004 | Martinson et al. |
| 6,779,681 | B2 | | 8/2004 | Doerfler et al. |
| 6,868,980 | B2 | | 3/2005 | Schultz et al. |
| 6,957,612 | B2 | | 10/2005 | Conlee |
| 7,055,442 | B2 | | 6/2006 | Podd et al. |
| 7,341,019 | B1 | | 3/2008 | Tsengas |
| D618,862 | S | | 6/2010 | Shamoon et al. |
| 8,528,489 | B2 | | 9/2013 | Roy et al. |
| 2002/0069793 | A1 | | 6/2002 | Clores |
| 2003/0079661 | A1 | | 5/2003 | Luu |
| 2003/0173359 | A1 | | 9/2003 | Nester et al. |
| 2008/0092786 | A1 | | 4/2008 | Chen |
| 2010/0186638 | A1 | | 7/2010 | Roy et al. |

FOREIGN PATENT DOCUMENTS

| | | |
|---|---|---|
| GB | 2286524 | 8/1995 |
| WO | 8908011 | 9/1989 |

OTHER PUBLICATIONS

EPO Communication dated Mar. 12, 2012 in European Patent Application No. 10706355.4.

Response to EPO Communication filed Dec. 28, 2012 in European Patent Application No. 10706355.4.

EPO Communication dated May 16, 2014 in European Patent Application No. 10706355.4.

Response to Office Action filed Jun. 13, 2014 in Canadian Patent Application No. 2,750,594.

Office Action dated Jan. 24, 2014 in Chinese Patent Application No. 201080013665.6 and English translation thereof.

MEGA Brands Board Dudes Magnetic Dry-Erase Lap Desk, 2 pages, 2007.

International Search Report and Written Opinion mailed Jun. 16, 2010 in PCT Application No. PCT/IB2010/000123.

Notification Concerning Transmittal of International Preliminary Report on Patentability (including IPER and Written Opinion of the ISA) mailed Aug. 4, 2011 in International Application No. PCT/IB2010/000123.

Chinese Office Action dated Jun. 26, 2013 in Chinese Patent Application No. 201080013665.6 and English translation thereof.

Office Action dated Feb. 21, 2014 in Canadian Patent Application No. 2,750,594.

Office Action dated Oct. 23, 2013 in Mexican Patent Application No. MX/a/2011/007871 and English translation thereof.

Response to Office Action filed Mar. 26, 2014 in Chinese Patent Application No. 201080013665.6, and English translation thereof.

* cited by examiner

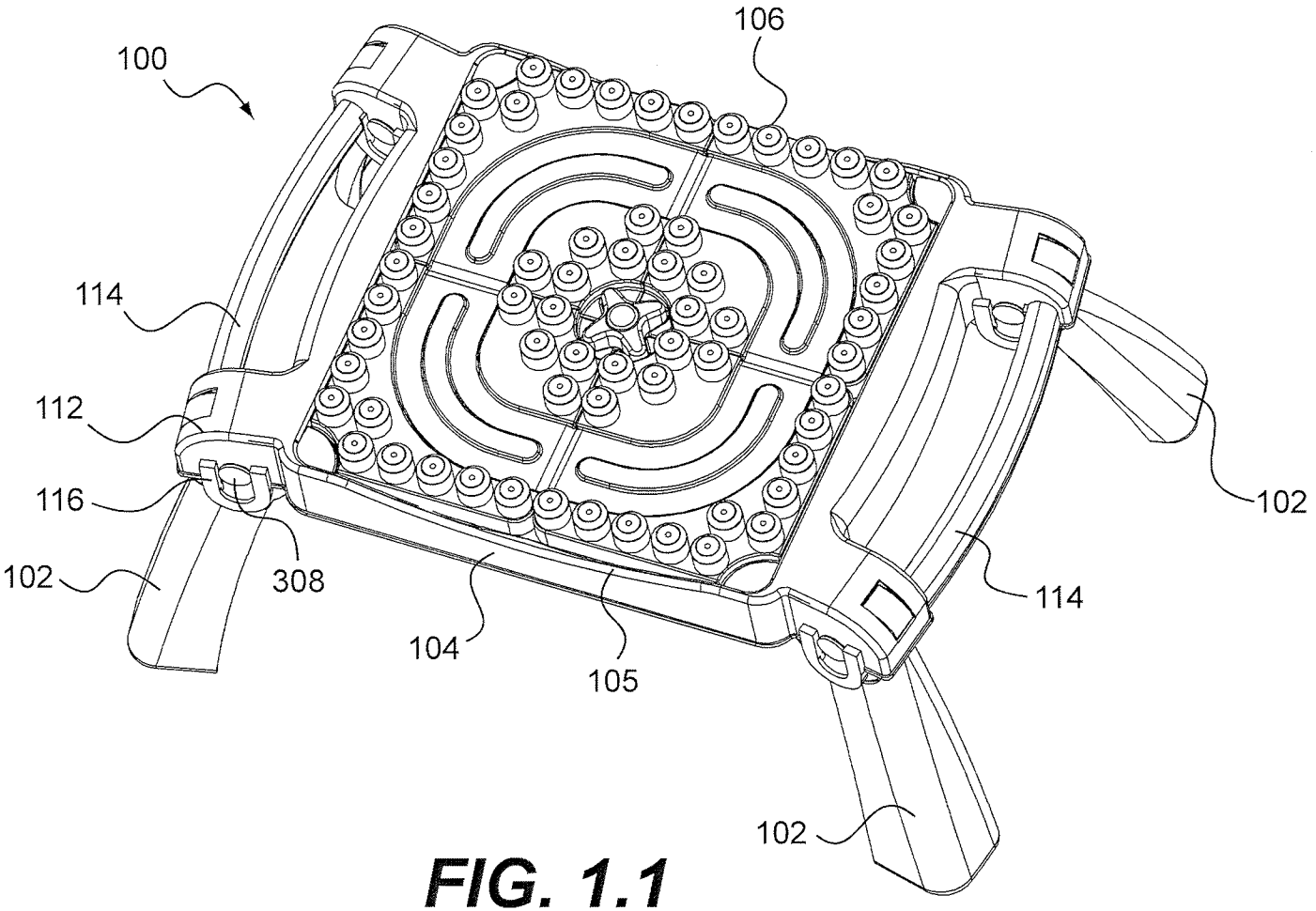
FIG. 1.1

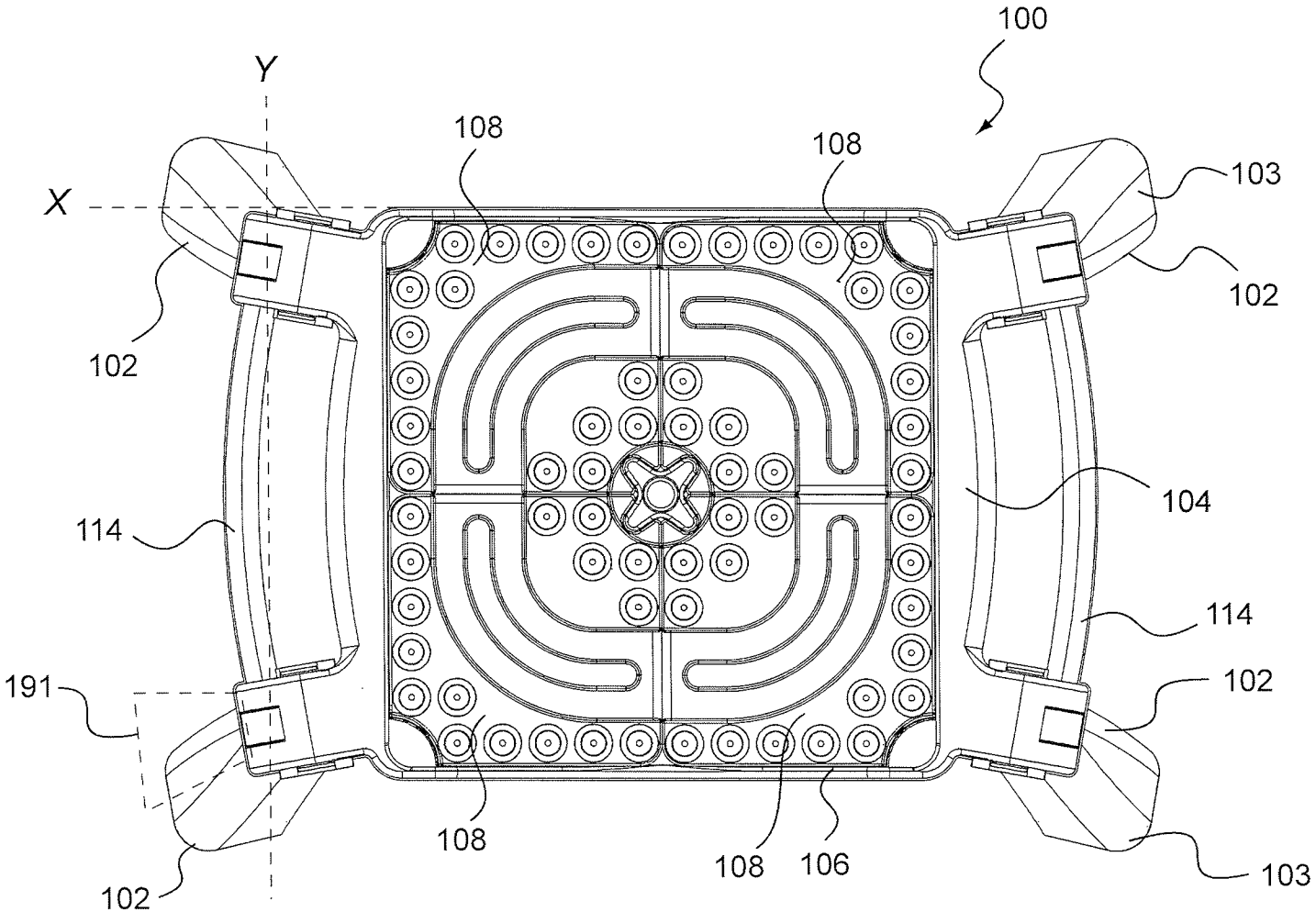
FIG. 1.2

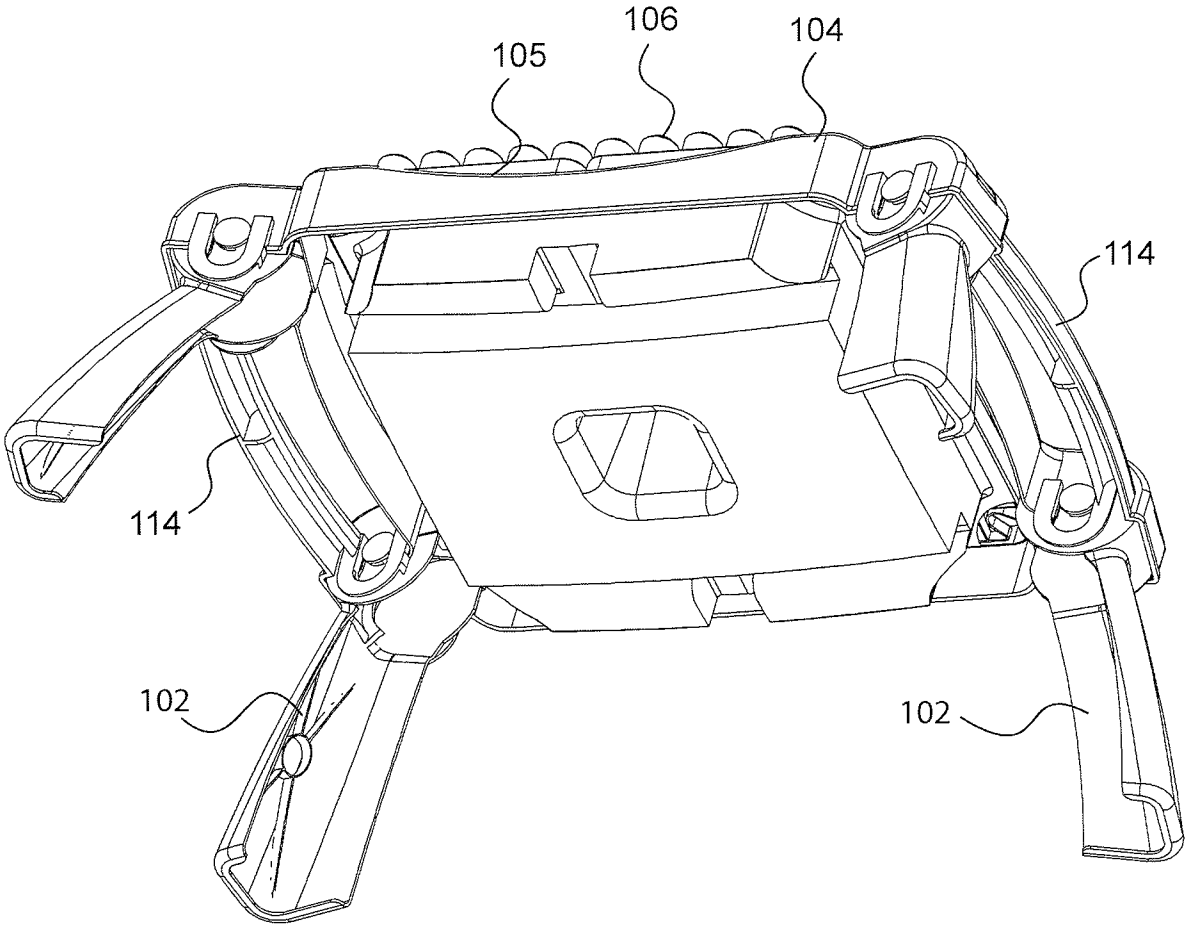
FIG. 1.3

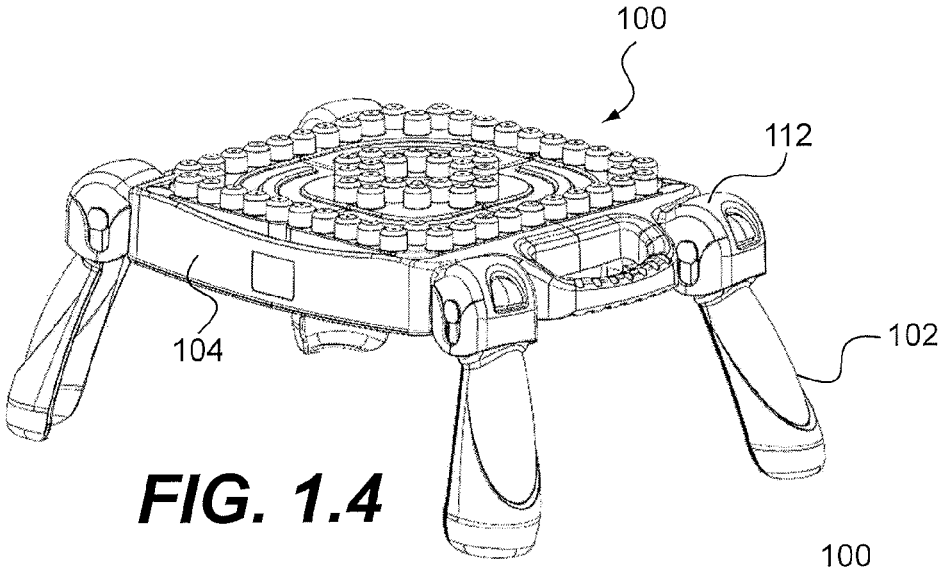
FIG. 1.4
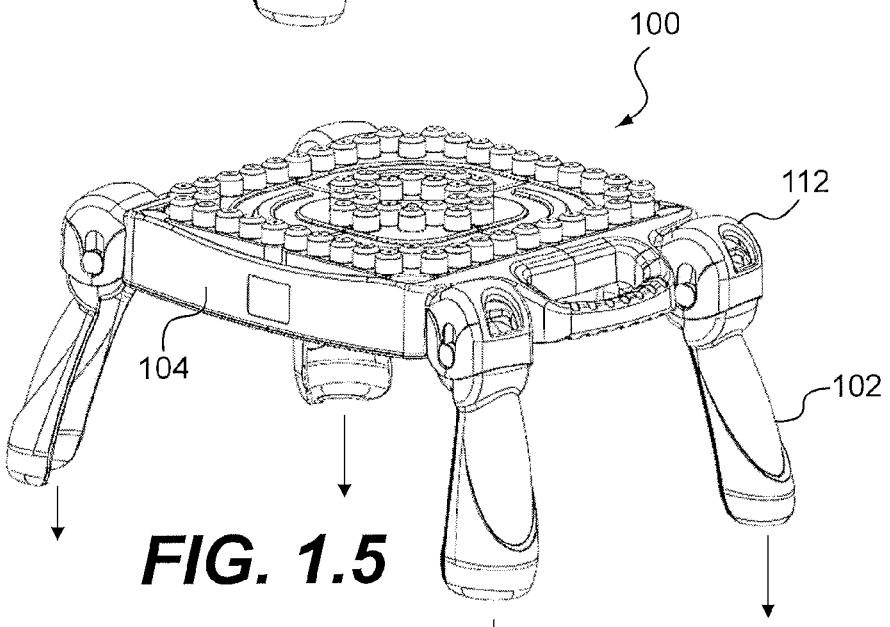
FIG. 1.5
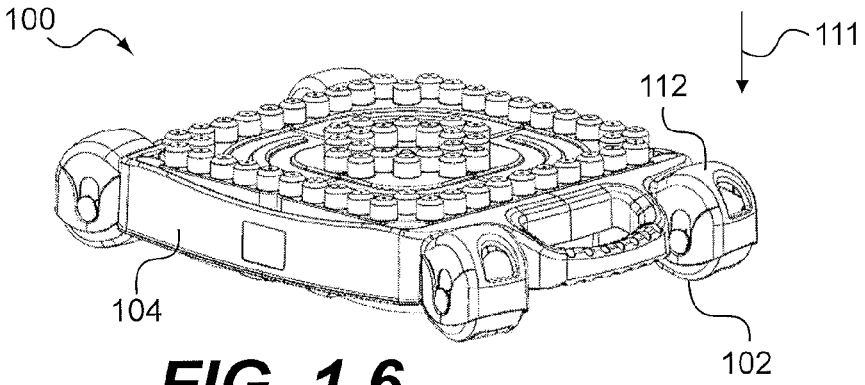
FIG. 1.6

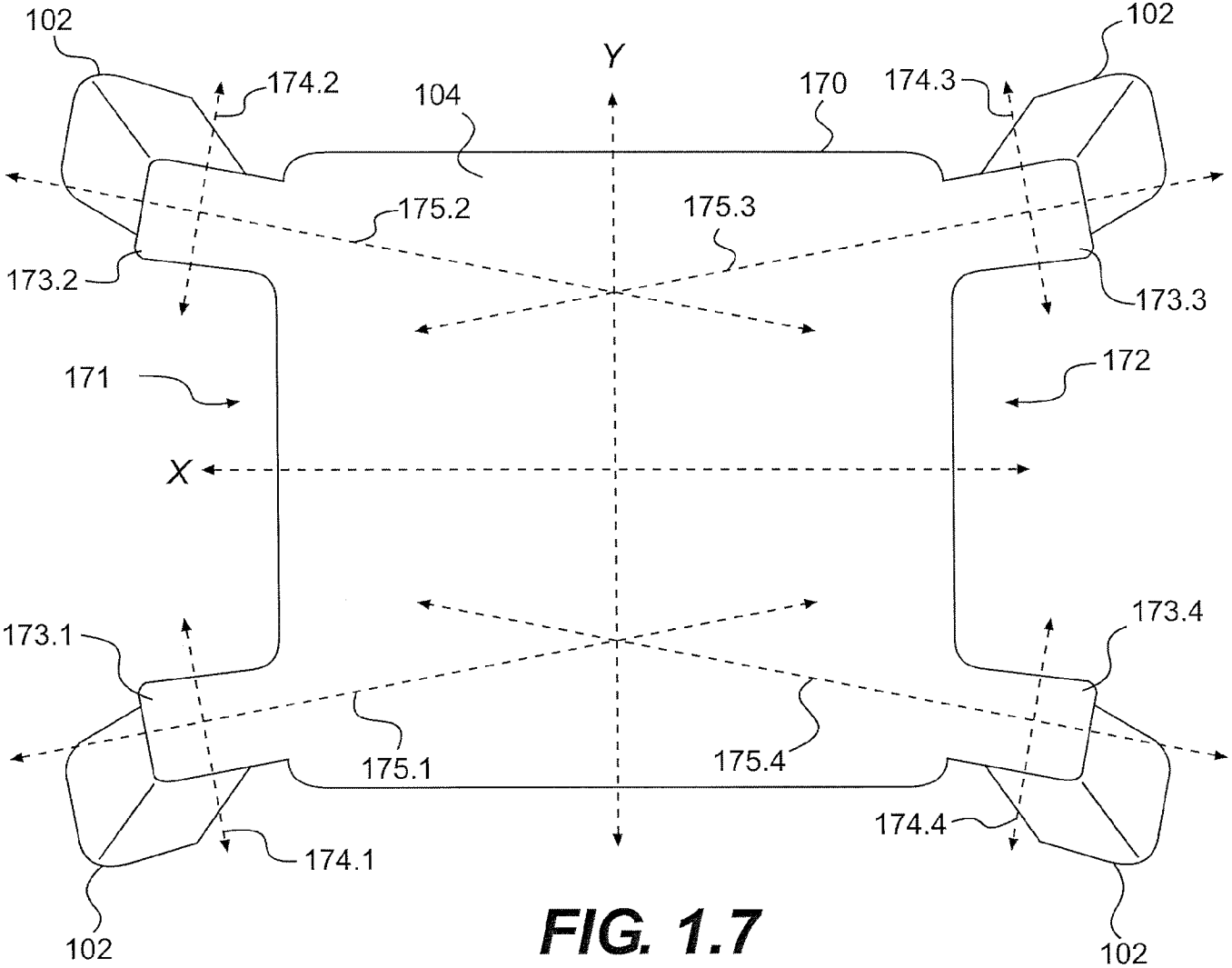
FIG. 1.7

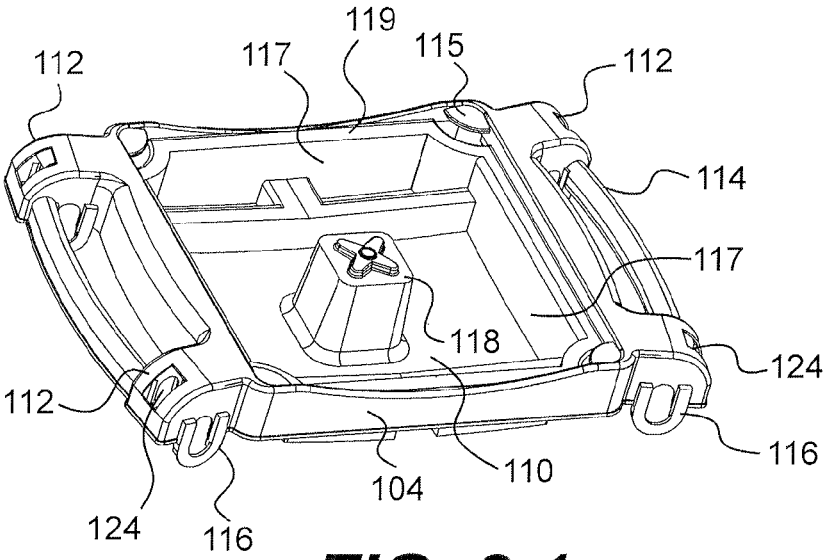
FIG. 2.1
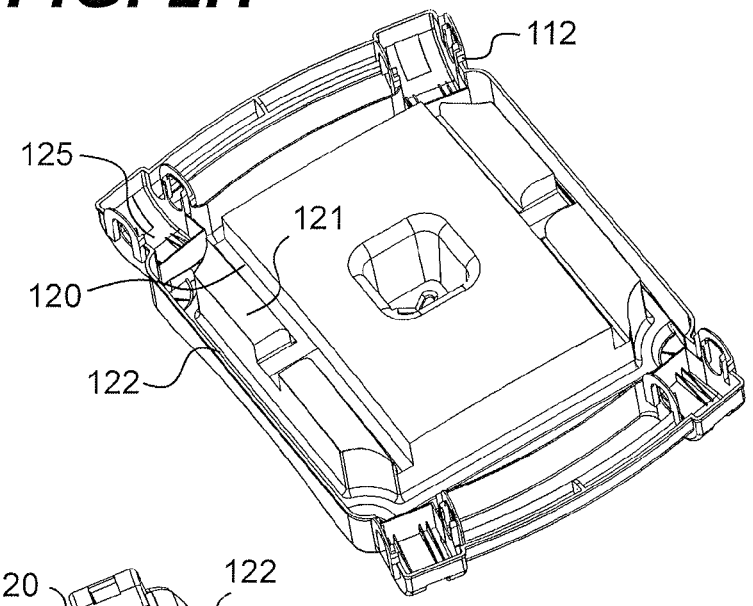
FIG. 2.2
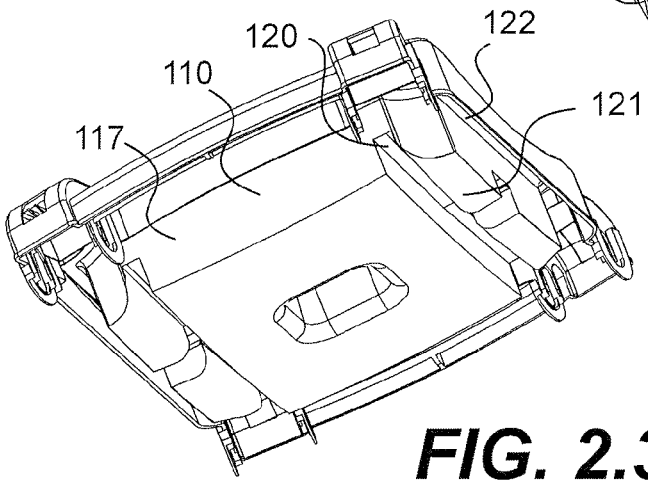
FIG. 2.3

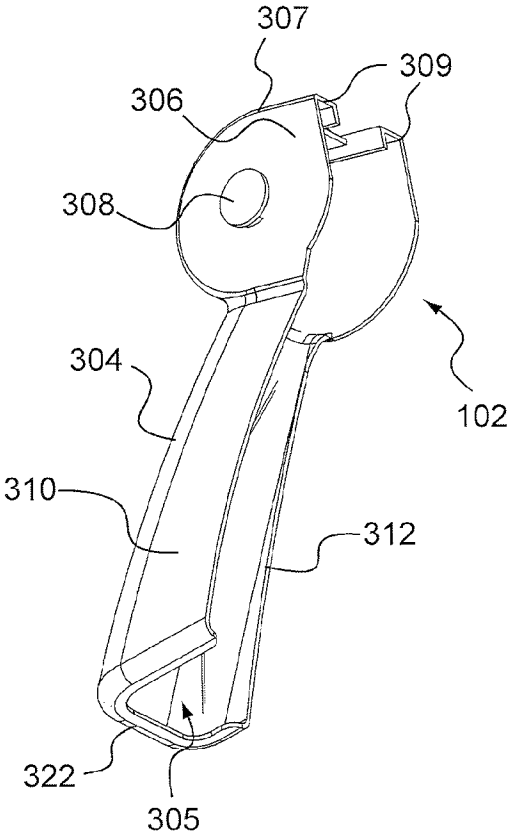
FIG. 3.3
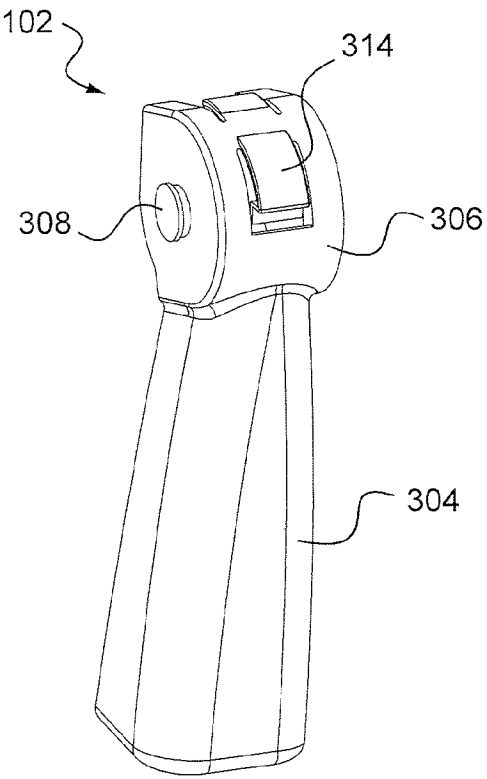
FIG. 3.2
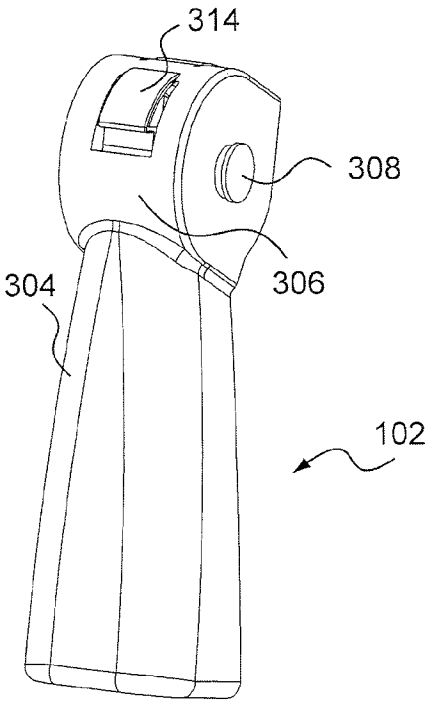
FIG. 3.1

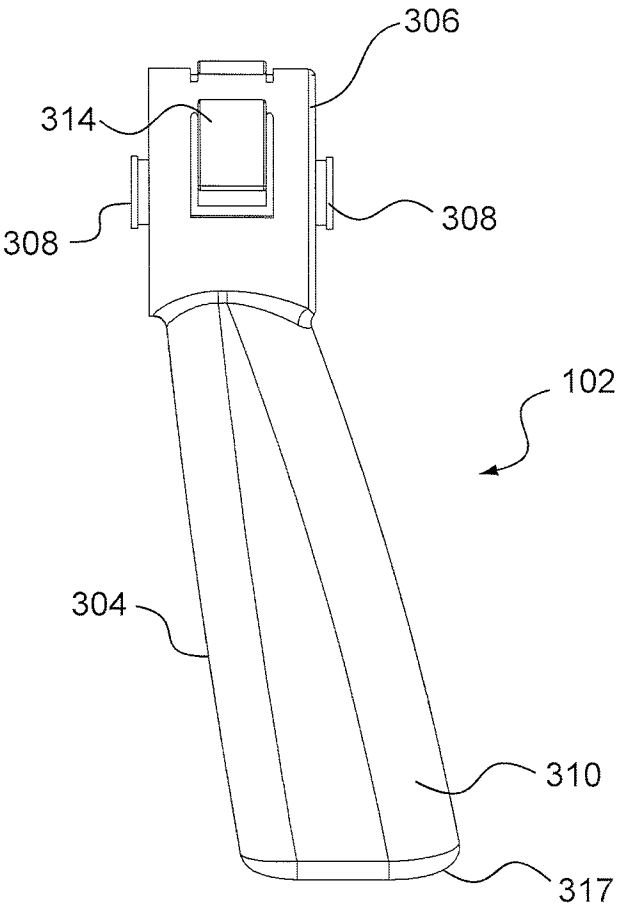
FIG. 3.5
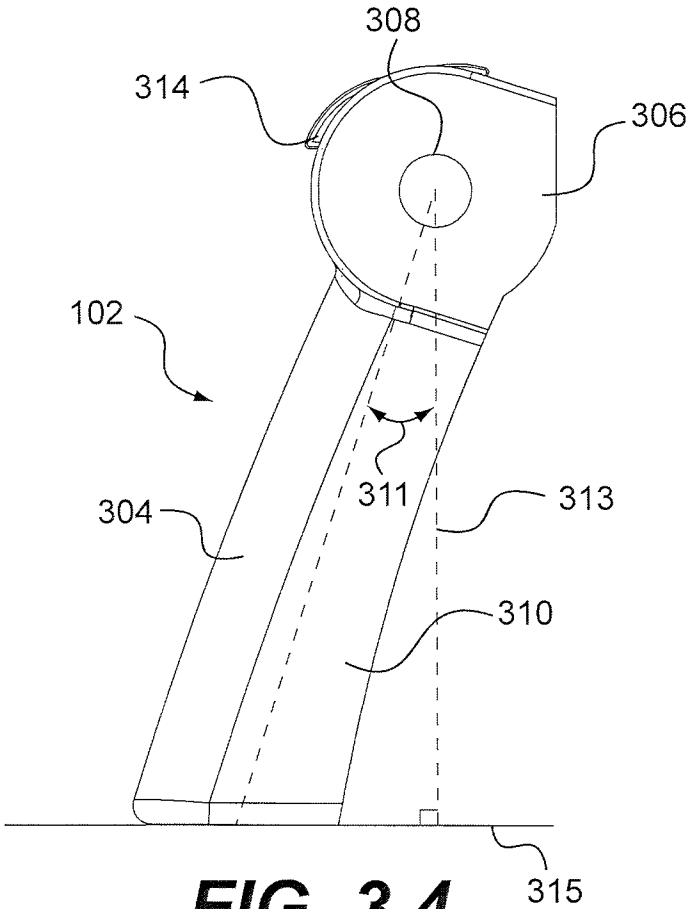
FIG. 3.4

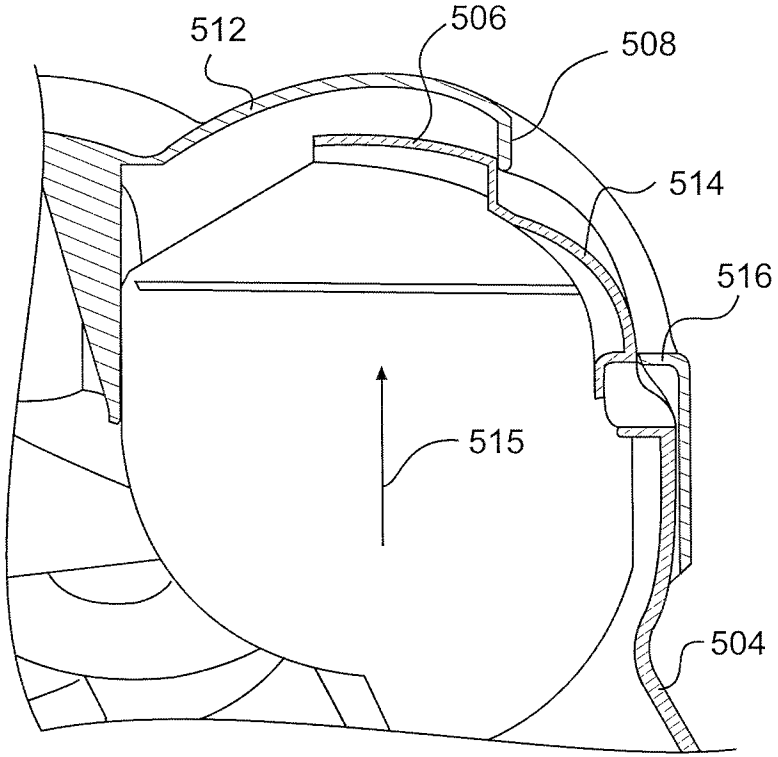
FIG. 5.2
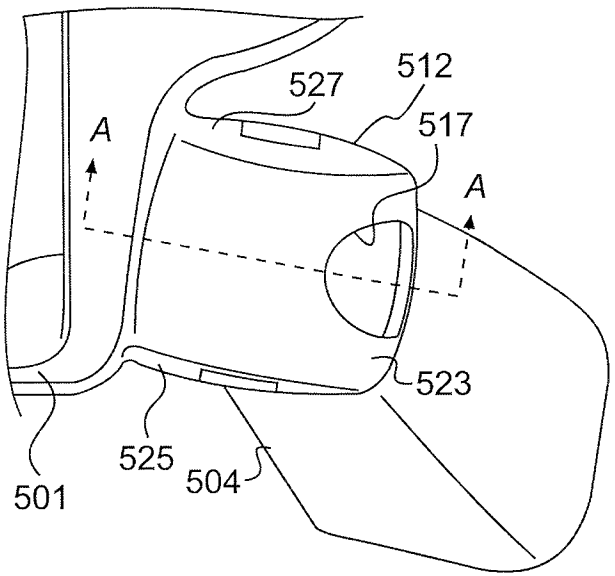
FIG. 5.1

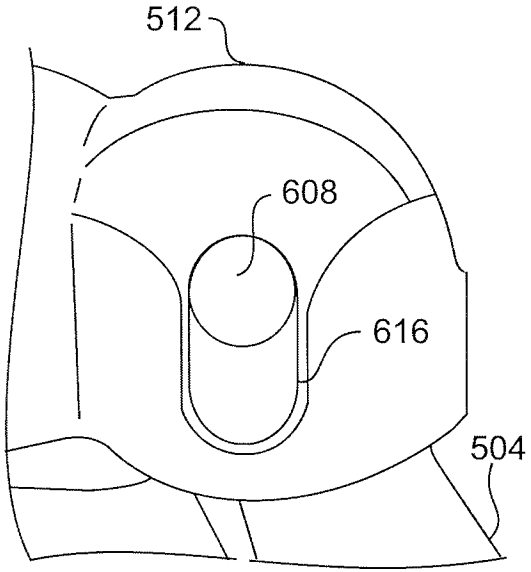
FIG. 5.4
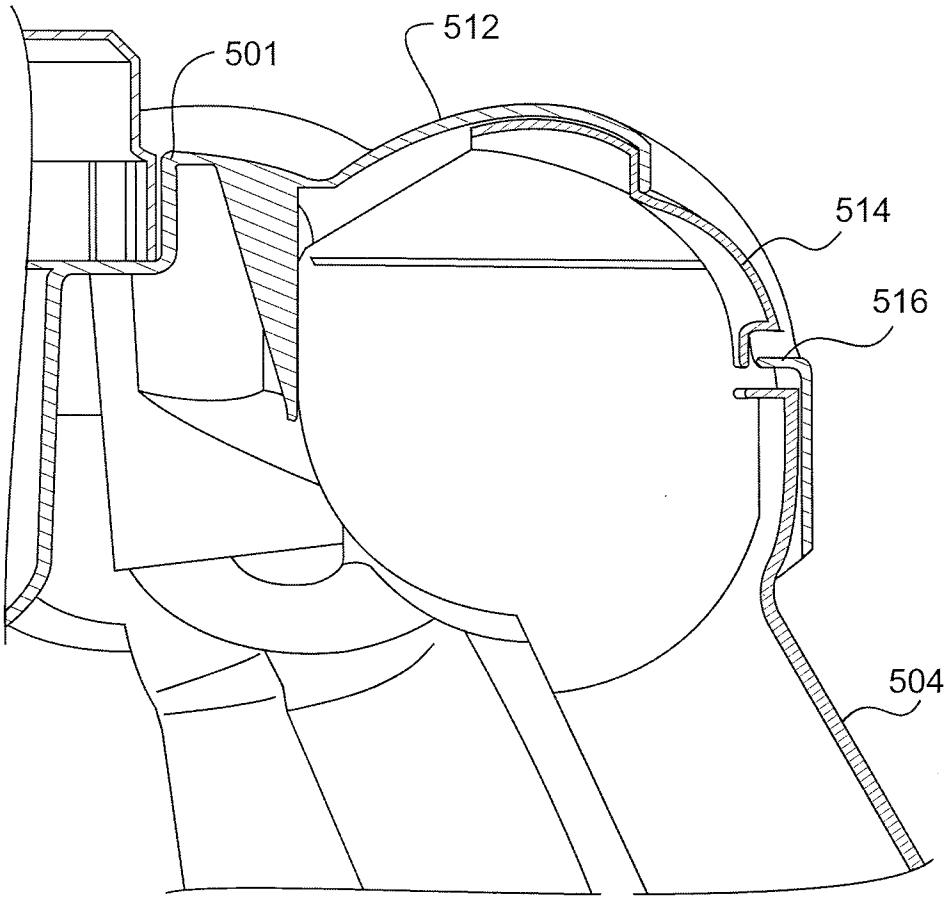
FIG. 5.3

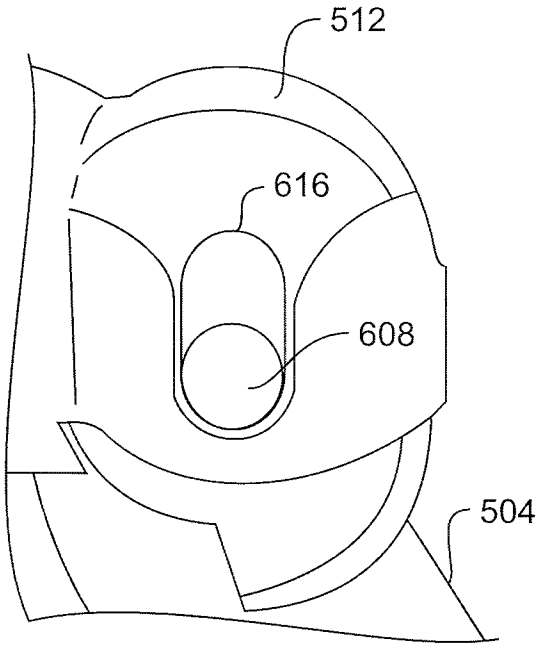
FIG. 6.2
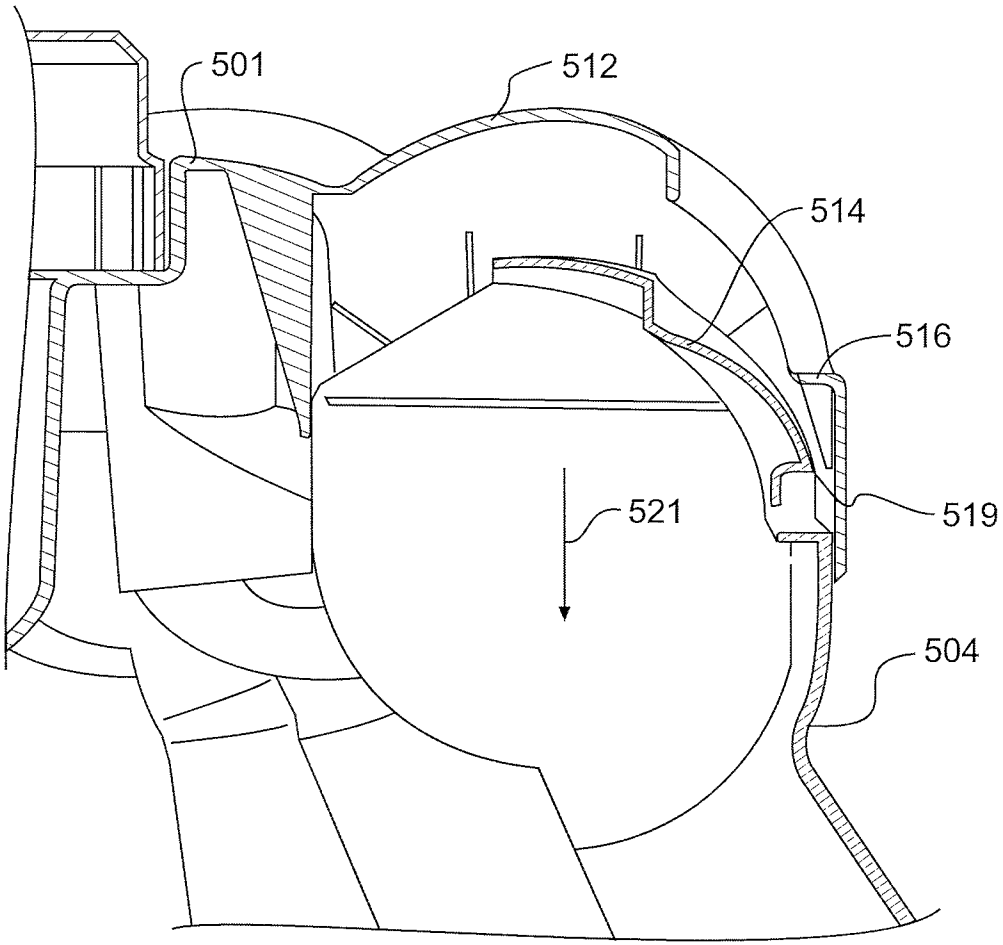
FIG. 6.1

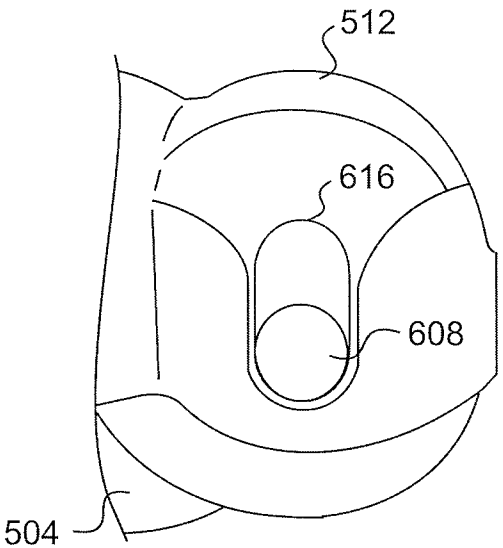
FIG. 7.2
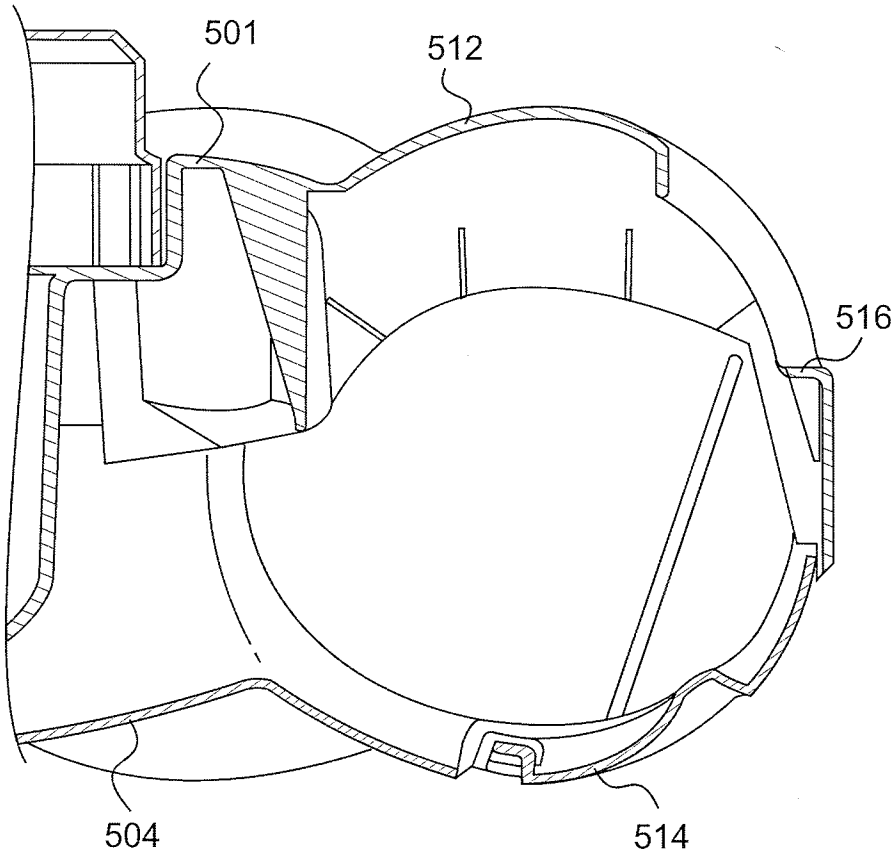
FIG. 7.1

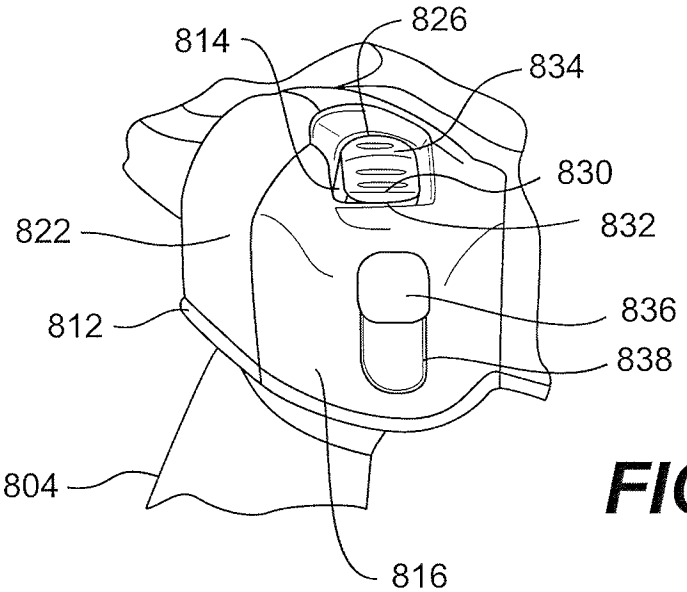
FIG. 8.1
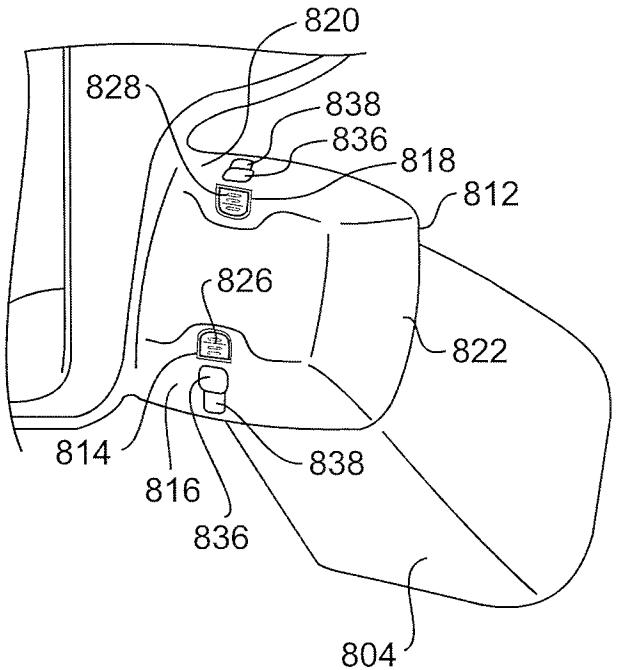
FIG. 8.2

FOLDABLE TABLE

This application is a continuation of U.S. application Ser. No. 12/691,249, filed Jan. 21, 2010 (U.S. Patent Publication No. US 2010/0186638, published Jul. 29, 2010), which claims the benefit of U.S. Provisional Application No. 61/147,298, filed Jan. 26, 2009, both of which are herein incorporated by reference in their entirety.

BACKGROUND

1. Field of the Invention

The present invention relates generally to folding tables and more specifically, to a folding table that provides stability-enhancing legs and a user-assembled work or play surface.

2. Background of the Invention

Tables with removable or folding legs provide a work or play surface that can be conveniently transported, set up, broken down, and stored. To provide that portability, such tables are often manufactured from lightweight materials such as plastic. Using lightweight materials, however, presents a challenge in providing a table that is sufficiently sturdy, strong, and durable for the intended use. Thus, product designers strive to strike the right balance in providing a portable, lightweight table that is sufficiently strong to withstand the rigors of its use.

SUMMARY

The present invention provides a folding table that is configured to provide enhanced stability when the table legs are placed in an extended position. The folding table may be, for example, a children's folding play table.

In one aspect, a foldable table may include a table top defining an outer perimeter when viewed from a top plan view. When viewed from the top plan view, the table top may comprise a first side, a second side opposite to the first side, a first socket, a second socket, a third socket, and a fourth socket. The first socket may be disposed on the first side and may define a first rotational axis and a first radial direction that is radial to the first rotational axis. The second socket may be disposed on the first side and may define a second rotational axis and a second radial direction that is radial to the second rotational axis. The third socket may be disposed on the second side and may define a third rotational axis and a third radial direction that is radial to the third rotational axis. The fourth socket may be disposed on the second side and may define a fourth rotational axis and a fourth radial direction that is radial to the fourth rotational axis. The first radial direction and the second radial direction may diverge from each other in a direction away from the table top and may converge in a direction toward the second side. The third radial direction and the fourth radial direction may diverge from each other in a direction away from the table top and may converge in a direction toward the first side. A leg may be attached to each of the first, second, third, and fourth sockets. The leg may include a head portion and an extension portion. The head portion may rotate around the rotational axis, and along the radial direction, of the respective socket, from a folded position to an extended position. In the folded position, the extension portion may be contained within the outer perimeter of the table top in the plan view. In the extended position, the extension portion may extend beyond the outer perimeter of the table top in the respective radial direction in the plan view.

In another aspect, the first radial direction may be substantially parallel to the third radial direction and the second radial direction may be substantially parallel to the fourth radial direction.

In another aspect, when viewed from the top plan view, the first radial direction, the second radial direction, the third radial direction, and the fourth radial direction may be at an angle to a horizontal line drawn from the first side to the second side, and the angle may be within a range of about 5-20 degrees.

In another aspect, when viewed in the plan view, the first side and the second side may extend in a vertical Y-direction and may be opposite each other in a horizontal X-direction, and in the extended position, the extension portion may extend beyond the outer perimeter of the table top in both the X-direction and the Y-direction.

In another aspect, the foldable table may further include a handle member extending between the first socket and the second socket and defining an opening at the first side of the table top.

In another aspect, the head portion of the leg may comprise a post. The first socket may define a slot extending generally radial to the first rotational axis. The slot may have a first lower end and a second upper end when the foldable table is viewed from a side view. The post of the head portion may be disposed in and slidable within the slot. In the folded position, the post may be disposed at the first lower end of the slot and the head portion may be rotatable within the first socket. In the extended position, the post may be disposed at the second upper end of the slot and the head portion may be rotationally fixed within the first socket.

In another aspect, the head portion may have a first contact surface and an interior of the first socket may have a second contact surface. In the extended position, the first contact surface and the second contact surface may contact each other to prevent rotation of the head portion within the first socket.

In another aspect, the first socket may define an opening having a ledge. The head portion may have a resilient tab, which, in the extended position, may be disposed within the opening and against the ledge to prevent movement of the head portion within the first socket.

In another aspect, the first socket may comprise a first face generally perpendicular to the first rotational axis, and a second face opposite to the first face and generally perpendicular to the first rotational axis. The first face may define a first opening and the second face may define a second opening. The head portion of the leg may comprise a first resilient tab that is disposed within the first opening when the leg is in the extended position and rests against a first ledge of the first opening, and a second resilient tab that is disposed within the second opening when the leg is in the extended position and rests against a second ledge of the second opening. The first resilient tab and the second resilient tab may be temporarily deflectable such that a first force applied to the first resilient tab deflects the first resilient tab such that the first resilient tab clears the first ledge, and a second force applied to the second resilient tab deflects the second resilient tab such that the second resilient tab clears the second ledge, at which point the head portion of the leg may be movable in a direction away from the socket.

In another aspect, when the table is viewed from a side view, the table top may comprise a recessed portion that may be recessed with respect to a top surface of the table top and may be adjacent to the first socket. The post of the head portion may be disposed at the lower end to pivot the leg such that the extended portion of the leg may be positioned substantially parallel to a horizontal underside surface of the recessed portion.

In another aspect, the extended portion of the leg may define a hollow cavity, wherein in the folded position, the recessed portion of the table top may be disposed within the hollow cavity of the extended portion.

In another aspect, the table top may define a channel between an outer wall of the table top and the recessed portion of the table top. The channel may extend between the first side and the second side. The extended portion of the leg may have an outer wall and a transverse wall that is transverse to the outer wall. In the folded position, the outer wall may be disposed inside the channel and the transverse wall may be disposed against the horizontal underside surface of the recessed portion.

In another aspect, when viewed from a side view, the table top may comprise a recessed portion that may be recessed from a top surface of the table top. The foldable table may further comprise a removable plate that covers the recessed portion.

In another aspect, the table top may define a pedestal portion within the recessed portion. The removable plate may rest on the pedestal portion.

In another aspect, when viewed from a side view, the table top may comprise a recessed portion that may be recessed from a top surface of the table top. The recessed portion may comprise a perimeter shelf and a pedestal portion at an interior location of the recessed portion. The foldable table may further comprise a plurality of removable plates that cover the recessed portion. Each removable plate of the plurality of removable plates may rest on the perimeter shelf and the pedestal portion. The foldable table may further comprise a lock that secures the plurality of removable plates to the pedestal portion.

In another aspect, for each removable plate, the table top may include a tab disposed over the each removable plate that secures the each removable plate to the table top.

In another aspect, each removable plate may include a plurality of building posts configured to receive toy construction blocks.

In another aspect, the table top and legs may be made of plastic.

Another aspect provides a folding table including a table top that has a set of four sockets and a set of four legs that are each configured to assemble into a respective socket. When each of the four legs is assembled into a respective socket, each leg may be configured to rotate under the table top into a storage position, and to rotate outwardly away from the table top into an operational position. In the operational position, the bottom of each leg may extend outwardly so as not to be directly under the table top. Accordingly, in the operational position, the folding table may exhibit increased mechanical stability.

In another aspect, each socket may comprise a slot configured to provide a slidable motion of a corresponding foldable leg with respect to the each socket. In the operational position, the foldable leg may be disposed relatively upwardly within the slot. In the operational position, the foldable leg may be prevented from rotation about the each socket. When the foldable leg is disposed relatively downwardly within the slot, the foldable leg may be configured to freely rotate into the storage position.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 1.1 is a schematic diagram that depicts a perspective view of an embodiment of a folding table in an operational position, with the legs in an extended position.

FIG. 1.2 is a schematic diagram that depicts a plan view of the folding table shown in FIG. 1.1.

FIG. 1.3 is a schematic diagram that depicts a bottom perspective view of the folding table shown in FIG. 1.1.

FIG. 1.4 is a schematic diagram that depicts an embodiment of a folding table in an operational position in which the table legs are locked into place in an extended position.

FIG. 1.5 is a schematic diagram that depicts an embodiment of the folding table of FIG. 1.4 in a release position.

FIG. 1.6 is a schematic diagram that depicts an embodiment of the folding table of FIG. 1.4 in a folded position.

FIG. 1.7 is a schematic diagram that depicts a plan view of a table top, to illustrate an embodiment of socket orientation.

FIG. 2.1 is a schematic diagram that depicts a top perspective view of an embodiment of the table top of the folding table of FIG. 1.1.

FIGS. 2.2 and 2.3 are schematic diagrams that depict bottom perspective views of the table top of FIG. 2.1.

FIGS. 3.1 and 3.2 are schematic diagrams that depict a perspective view of embodiments of a first and a second table leg of the folding table depicted in FIG. 1.1.

FIGS. 3.3, 3.4, and 3.5 are schematic diagrams that depict a bottom perspective view, a side view, and an end view, respectively, of the first table leg depicted in FIG. 3.1.

FIGS. 5.1-5.4 are schematic diagrams that depict an embodiment of a table leg being locked into place in an extended position, with FIG. 5.1 depicting a plan view, with FIGS. 5.2 and 5.3 depicting partial cross-sectional views taken along line A-A of FIG. 5.1, and with FIG. 5.4 depicting a partial side view.

FIGS. 6.1 and 6.2 are schematic diagrams that depict an embodiment of a table leg moved towards a release position, with FIG. 6.1 depicting a partial cross-sectional view corresponding generally to the view of FIG. 5.2, and with FIG. 6.2 depicting a partial side view.

FIGS. 7.1 and 7.2 are schematic diagrams that depict an embodiment of a table leg rotated into a folded position, with FIG. 7.1 depicting a partial cross-sectional view corresponding generally to the view of FIG. 5.2, and with FIG. 7.2 depicting a partial side view.

FIG. 8.1 is a schematic diagram of an isometric view of another embodiment of a table leg locked into place inside a socket in an extended position, with resilient tabs of the leg disposed at faces of the socket that are generally perpendicular to the pivot axis of the leg.

FIG. 8.2 is a schematic diagram of a plan view of the table leg and socket depicted in FIG. 8.1.

DETAILED DESCRIPTION

Figure 4:
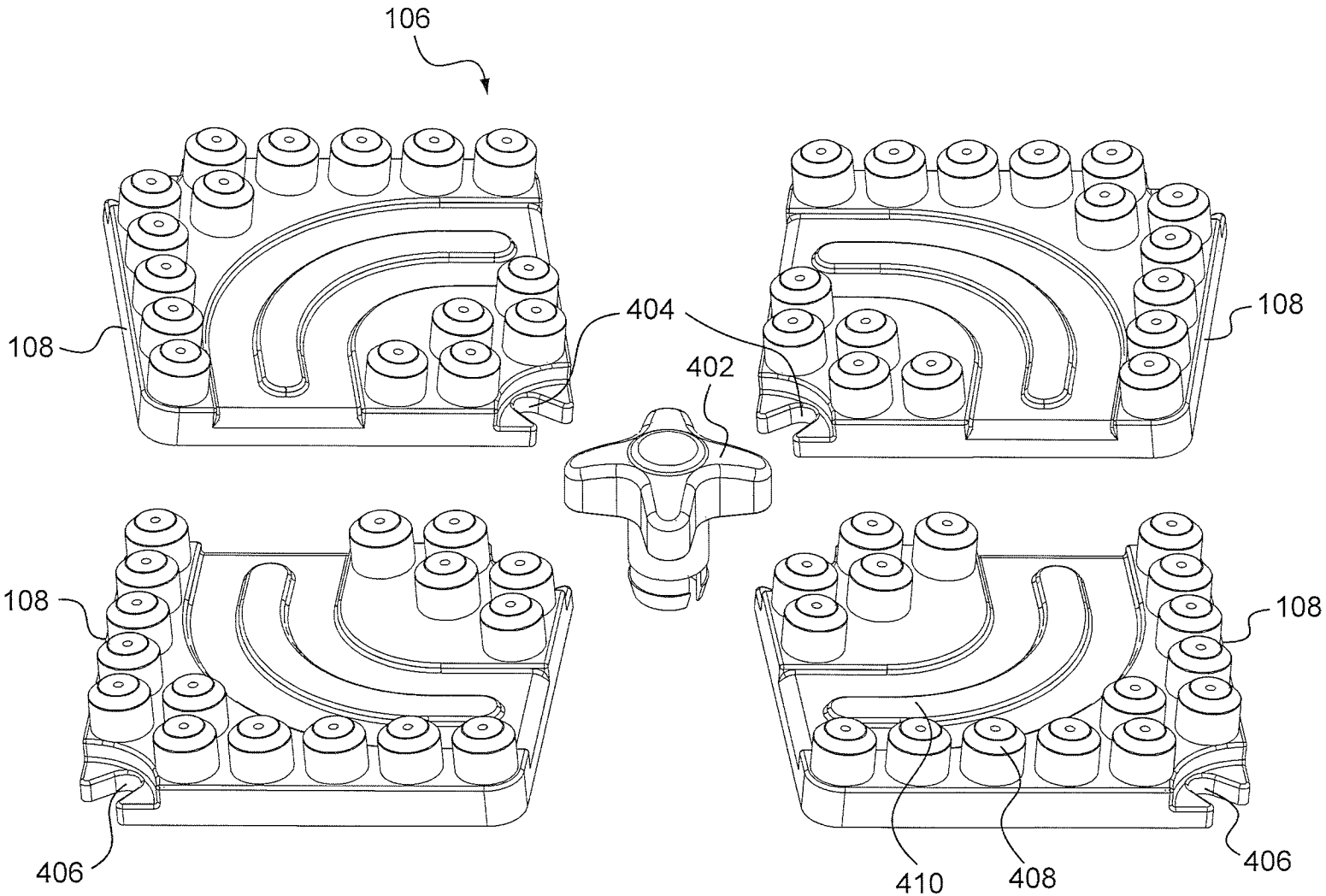
FIG. 4 is a schematic diagram that depicts an exploded view of an embodiment of a table top building surface and lock.

FIGS. 1.1-1.3 depict views of an embodiment of a folding table 100 arranged in an operational configuration. The term "folding table," as used herein, generally refers to a table that has components that are configured to fold against one another, such as legs that fold against a table top by pivoting around a pivot post in a socket. Among other features, folding table 100 may include a table top 104 and four legs 102. As shown in the embodiment depicted in FIGS. 1.1-1.3, folding table 100 may be configured to accommodate a removable play surface 106, as discussed further below. The removable play surface may, for example, be a surface that includes vehicle tracks, such as train tracks. In some embodiments, the table top 104 may be configured for use with water or sand. In other embodiments, table top 104 may provide a plain table top surface, such as a substantially flat surface (e.g., a desk surface, a dry-erase marker board surface, or a blackboard surface).

In the discussion to follow, similar, but not necessarily identical, features may be referred to by the same reference numeral. For example, the table top 104 and legs 102 of table 100 depicted in FIGS. 1.1-1.3 are similar to, but slightly differ from, their counterparts depicted in FIGS. 1.4-1.6.

Table 100 may include provisions that facilitate both enhanced mechanical stability, as well as portability. As depicted in the top plan view of FIG. 1.2, the bottom portion 103 (distal portion) of each of legs 102 may extend outwardly, so as not to be directly under table top 104. This configuration may provide enhanced stability to table 100 in comparison to table structures in which the legs are substantially orthogonal to the table top and in which the bottom of each of the legs does not extend substantially outside the "footprint" of the table top, when observed in a plan view.

As described further below, table 100 may further include provisions for folding and locking folding legs 102 into a storage position and for retaining legs 102 in a stable operational position. FIGS. 1.4-1.6 depict general aspects of the operation of an embodiment of a folding and locking mechanism. In FIG. 1.4, legs 102 are extended in an operational position. In FIG. 1.5, legs 102 are in a release position after being pulled downwardly with respect to sockets 112 and table top 104 (as represented by arrows 111), releasing legs 102 from the locked position. In FIG. 1.6, legs 102 are in a folded position, in which the legs are pivoted inwardly after being in the release position. Notably, the term "leg 102" refers to a leg in a set of legs in which the features of each leg are generally the same, except that the symmetry of features can vary between legs. In other words, for example, one leg 102 can be a mirror image of another leg 102.

Table top 104 may have a substantially square shape as observed in a plan view, as in the embodiment illustrated in FIGS. 1.2. Other shapes (e.g., rectangular) and side contours are, of course, possible. For example, table top 104 may include nonlinear sides, such as sides that curve outward. Table top 104 may also include handles, such as a set of two handles 114 located between respective pairs of sockets 112, as shown in FIGS. 1.1-1.3, for example. A handle 114 may define an opening between the handle 114 and the table top 104, as shown, which may accommodate a user's fingers. The sides of table top 104 may also be curved when viewed from the side, such as the curved side 105 shown in FIGS. 1.1 and 1.3.

Referring also to FIGS. 2.1-2.3, table top 104 may comprise a three dimensional shape having a recessed portion 110 whose sides 117 define a substantially square shape. Recessed portion 110 may also include a central pedestal portion 118. Recessed portion 110 may be configured to accommodate a table top play surface, such as play surface 106 illustrated in FIGS. 1.1-1.3.

In plan view, as indicated in FIG. 1.2, sockets 112 may extend at an angle with respect to the sides 117, such that legs 102 extend beyond the "footprint" of table top 104 in both the X- and Y-directions. Table top 104 and legs 102 may each comprise a molded high strength plastic, made, for example, by a simple injection molding process. In some embodiments, such as that depicted in FIG. 3.4, an angle 311 formed by legs 102 may be about 10-20 degrees with respect to a vertical line 313 orthogonal to a horizontal surface 315 on which table 100 may be placed in an operational position. In one embodiment, angle 311 may be about 15 degrees. This configuration may allow table 100 to pass a tipping test in which the table remains upright when a 50 kg force is placed on the table top when the table top is at an incline of 15 degrees from horizontal, and to pass an overload test when an 80 kg force is applied to the table top when table 100 rests on a flat, horizontal surface.

In extending legs 102 beyond the footprint of a table top 104 to provide improved mechanical stability, some embodiments may include provisions for orienting the sockets 112 with respect to each other. FIG. 1.7 illustrates an embodiment of socket orientation. As shown in the plan view of FIG. 1.7, a table top 104 may define an outer perimeter 170 and include a first side 171, a second side 172 opposite to the first side 171, and a plurality of sockets 173.1, 173.2, 173.3, and 173.4. As shown, first socket 173.1 may be disposed on the first side 171 and may define a first rotational axis 174.1 and a first radial direction 175.1 that is radial to the first rotational axis 174.2. Second socket 173.2 may be disposed on the first side 171 and may define a second rotational axis 174.2 and a second radial direction 175.2 that is radial to the second rotational axis 174.2. Third socket 173.3 may be disposed on the second side 172 and may define a third rotational axis 174.3 and a third radial direction 175.3 that is radial to the third rotational axis 174.3. Fourth socket 173.4 may be disposed on the second side 172 and may define a fourth rotational axis 174.4 and a fourth radial direction 175.4 that is radial to the fourth rotational axis 174.4.

To provide the outward placement of legs 102, as shown, the first radial direction 175.1 and the second radial direction 175.2 may diverge from each other in a direction away from the table top 104 and converge in a direction toward the second side 172. Likewise, the third radial direction 175.3 and the fourth radial direction 175.4 may diverge from each other in a direction away from the table top 104 and converge in a direction toward the first side 171. The legs 102 attached to each of the sockets 173.1, 173.2, 173.3, and 173.4 may each include a head portion within the socket and an extension portion extending from the socket, with the head portion rotating around the rotational axis, and along the radial direction, of the respective socket, from a folded position to an extended position. In the folded position, the extension portion may be contained within the outer perimeter 170 of the table top in the plan view, and in the extended position, the extension portion of the legs 102 may extend beyond the outer perimeter 170 of the table top 104 in the respective radial directions, as shown in the plan view of FIG. 1.7. In embodiments, the extension portion may extend beyond the outer perimeter 170 of the table top 104 in the X-direction and/or the Y-direction.

To provide stability and balance to a foldable table, some embodiments provide a symmetrical arrangement of sockets. For example, with reference to FIG. 1.7, a table top 104 may have a symmetrical polygon shape with sockets disposed symmetrically at the corners (in this case, symmetrical with respect to the Y-axis). For symmetry of the socket orientation, the first radial direction 175.1 may be substantially parallel to the third radial direction 175.3 and the second radial direction 175.2 may be substantially parallel to the fourth radial direction 175.4. To provide desirable stability, in some embodiments, the first radial direction 175.1, the second radial direction 175.2, the third radial direction 175.3, and the fourth radial direction 175.4 may be at an angle of about 5-20 degrees to a horizontal line (such as the X-axis) drawn from the first side 171 to the second side 172.

In some embodiments, sockets of a table top may also include provisions for locking and releasing legs. For example, referring to FIGS. 1.1-1.6, each socket 112 of table top 104 may include a pair of opposing oblong slots 116 (e.g., U-shaped slots) arranged to accommodate legs 102 and to facilitate a pivoting and sliding motion of legs 102 with respect to table top 104. Referring again to FIG. 1.1 (see also FIG. 1.4 for a variant of socket 112), and also to FIG. 3.3, sockets 112 may accommodate a head portion 306 of legs 102 by enclosing posts 308 within oblong slots 116. Thus, in initially assembling the legs 102 and table top 104, legs 102 may be conveniently inserted into sockets 112 by flexing sockets 112 to accommodate posts 308 until the posts 308 snap into place inside U-shaped oblong slots 116. Head portion 306 and slots 116 may be configured such that head portion 306 can slide up and down along U-shaped oblong slots 116. In the operational position, as depicted in FIG. 1.1, posts 308 may be relatively upwardly disposed in U-shaped oblong slots 116. Referring also to FIGS. 2.2 and 3.3, in this configuration, top surface 307 of head portion 306 may be very near to or rest against a similarly shaped portion of the underside 125 of socket 112. Additionally, the vertical surface 309 may rest adjacent to a vertical surface in socket 112. The head portion 306 thus may be prevented from rotating with respect to socket 112.

In addition, any weight placed upon table top 104 may tend to maintain the secured, operational configuration illustrated in FIG. 1.1.

In some embodiments, a cooperating socket and leg may include only one slot and one post, instead of the two pairs shown in FIGS. 1.1-1.6 and 3.5, for example.

Sockets 112 may be configured such that each leg 102 may be slid into a foldable position by sliding head portion 306 downwardly, wherein post 308 slides toward the bottom of oblong slot 116. In the foldable position, head portion 306 may be disposed far enough away from the underside of socket 112, such that the flat shaped top 307 may rotate freely, allowing head 306 to pivot around the axis of pivoting post 308 within the oblong slot 116. This configuration may allow the extension portions 304 of legs 102 to pivot underneath table top 104.

In the embodiment illustrated in FIGS. 1.1-1.3 and 3.1-3.5, legs 102 may be hollow and comprise a wider outer side 310, a narrower inner side 312, and a transverse side 322 in between the sides 310 and 312. The wider outer side 310 may also contribute to the stability of table 100. In some embodiments, legs 102 may be shaped so as to completely tuck within the footprint of table top 104 when folded. In some embodiments, the inner and outer side of legs 102 may be the same size.

Referring to FIGS. 2.2 and 2.3, which depict views from underneath table top 104, a shallow inner channel 120 may be provided to accommodate narrower inner side 312 of leg 102, while a deeper outer channel 122 may be provided to accommodate wider outer side 310 of leg 102, when leg 102 is folded underneath table top 104. The open construction of the extension portion 304 of leg 102 defines a hollow cavity 305 (see FIG. 3.3) between the sides 310 and 312. Thus, when folded, a recessed portion 121 (see FIGS. 2.2 and 2.3) may be disposed within the hollow cavity 305, with the outer side 310 disposed inside the channel 122, the inner side 312 disposed inside channel 120, and the transverse side 322 disposed against the horizontal underside surface of recessed portion 121. Providing the slot 116 in the socket 112 may enable the post 308 of the leg 102 to move to the lowermost end of the slot 116 so that the leg 102 may pivot to position the extended portion 304 of the leg 102 substantially parallel to the horizontal undersurface of the recessed portion 121. This parallel arrangement may accommodate deep functional storage compartments in the table top, while still enabling the leg to lay flat against the underside of the table top, thereby providing a convenient, compact configuration of minimal depth, which eases transport and storage of the table top when the legs are in the folded position. For example, a table top may have functional storage compartments such as recessed portions 117 and 121, while still enabling compact stowing of the legs 102.

Referring now to FIG. 3.5, in one embodiment, the lower extension portion 304 of leg 102 may be angled outwardly with respect to the vertical direction of head portion 306. This configuration may cause the distal portion 317 of leg 102 to extend further outwardly from the front of table top 104 than would be the case if the extension portion 304 were arranged parallel to the head (see the representative region 191 in FIG. 1.2), further adding to the stability of table 100.

In one embodiment, as shown in FIG. 3.5, a leg 102 may include a locking mechanism 314 that may be configured to snap into a slot 124 provided in socket 112. This configuration may further prevent movement of leg 102 in the operational position, including rotational movement and movement in a downward direction away from the socket 112. Thus, to release the legs 102 from the operational position, a user may simultaneously press on mechanism 314 and pull down on leg 102. Locking mechanism 314 may be a resilient tab or button, for example.

FIGS. 5.1-7.2 depict further details of the operation of embodiments of a locking and folding mechanism operable on a foldable table. Referring also to FIGS. 1.4-1.6, FIGS. 5.1-5.4 depict the configuration of a socket 512 and table leg 504 that generally correspond to the operational position of table 100 depicted in FIG. 1.4; FIGS. 6.1-6.2 depict the socket and leg configuration corresponding to the table position depicted in FIG. 1.5; and FIGS. 7.1-7.2 depict the socket and leg configuration corresponding to the table position depicted in FIG. 1.6.

FIG. 5.1 depicts the configuration of a table leg 504 when locked into place in an extended position, according to one embodiment. FIG. 5.2 depicts, in a cross-section taken along line A-A of FIG. 5.1, the configuration of leg 504 as it moves in the general direction represented by arrow 515 and locks into place in socket 512 of table top 501. A ledge 506 in the top of leg 504 may engage a ridge 508 in socket 512, preventing rotation of leg 504. A resilient tab 514 of the leg 504 may be deflected to pass by a ledge 516 of socket 512. Further upward movement of leg 504 to the position depicted in FIG. 5.3, may cause resilient tab 514 to snap into place within opening 517 of socket 512 and rest against the ledge 516 in opening 517, further securing leg 504 from movement, including rotational movement and movement in a downward direction away from socket 512. As shown in the partial view of FIG. 5.4, in the locked position, post 608 may be at an uppermost point of the slot 616 of socket 512.

FIGS. 6.1-6.2 depict the situation in which leg 504 is moved towards a release position with respect to socket 512 of table top 501. To reach this release position, resilient tab 514 may be deflected inward so that its distal end 519 clears ledge 516, thereby enabling leg 504 to move in a direction generally away from socket 512 as represented by arrow 521. In the release position, leg 504 may then freely rotate within socket 512. As shown in the partial view of FIG. 6.2, in the release position, post 608 may be at a lowermost point of the slot 616 of socket 512.

FIGS. 7.1-7.2 depict the situation in which leg 504 is rotated into a folded position. As shown, resilient tab 514 may be rotated well past ledge 516 so that the leg 504 may be tucked underneath the table top 501. As shown in the partial view of FIG. 7.2, in the folded position, post 608 may be at a lowermost point of the slot 616 of socket 512. The movement of post 608 to the lowermost point enables the leg 504 to fully pivot (e.g., 90 degrees or more) to compactly stow leg 504 flat up against the underside of table top 501.

Although FIGS. 5.1-5.3, 6.1, and 7.1 illustrate an embodiment of a socket 512 in which one opening 517 (which cooperates with resilient tab 514) may be disposed on a face 523 of the socket 512 that is generally parallel to the pivot axis of the socket 512 and leg 504, alternative embodiments may position an opening in other locations, and may include multiple openings. For example, with reference to FIG. 5.1, an opening on the socket that cooperates with a resilient tab on the leg may be positioned on either or both of faces 525 and 527, which are generally perpendicular to the pivot axis of the socket 512 and leg 504. In some embodiments, openings and cooperating resilient tabs may be provided in multiple locations, including faces parallel and perpendicular to the pivot axis of the socket and leg, as well as faces in positions between parallel and perpendicular.

FIGS. 8.1 and 8.2 illustrate an embodiment of a socket and leg having two sets of openings and resilient tabs. As shown, socket 812 may include a first opening 814 on a first face 816 that may be generally perpendicular to the pivot axis of the socket 812 and leg 804, and a second opening 818 on a second face 820 that may be generally opposite to the first face 816 and may also be generally perpendicular to the pivot axis of the socket 812 and leg 804. Socket 812 may include a rounded third face 822 that may be generally parallel to the pivot axis of the socket 812 and leg 804. Leg 804 may include a first resilient tab 826 and a second resilient tab 828 that may cooperate with the first opening 814 and the second opening 818, respectively. Similar to the opening and resilient tab mechanism disclosed with reference to FIGS. 5.1-7.2, resilient tabs 826 and 828 may have a distal end 830 that cooperates with a ledge 832 of the socket 812. Resilient tabs 826 and 828 may also have ridges 834 that may provide a convenient surface for a user to grip the tabs with the user's fingers. The opposing arrangement of the resilient tabs may also conveniently enable the user to simultaneously grip the opposing tabs with a thumb and opposing finger, and squeeze the tabs toward each other in a direction generally parallel to the pivot axis of socket 812 and leg 804. FIG. 8.2 illustrates an embodiment of an opposing arrangement of resilient tabs, which may be positioned along a narrowed section of the rounded third face 822.

In moving leg 804 from a folded position into the locked position shown in FIGS. 8.1 and 8.2, the leg 804 may be pivoted around posts 836, with the posts 836 in a lowermost position in slots 838. As the leg 804 is pivoted, the resilient tabs 826 and 828 may be enclosed within socket 812. After the leg 804 is fully pivoted, for example, such that an outer surface of the leg 804 contacts an inner surface of the socket 812 (e.g., similar to ledge 506 engaging ridge 508 in FIG. 5.2), the leg 804 may be moved upward into the socket 812 until the posts 836 are in an uppermost position of slots 838, as shown in FIG. 8.1. As the posts 836 reach the uppermost position, the resilient tabs 826 and 828 may deflect inwardly toward each other so that the distal ends 830 of the tabs 826 and 828 clear the ledges 832 of the socket 812. After clearing the ledges 832, the resilient tabs 826 and 828 may snap back, with the distal ends 830 positioned over the ledges 832, thereby locking the leg 804 into position within the socket 812, and preventing movement of leg 804, including rotational movement and movement in a downward direction generally away from socket 812. To release the leg 804, a user may conveniently squeeze the resilient tabs 826 and 828 toward each other so that the distal ends 830 clear the ledges 832, enabling the leg 804 to slide downward away from the socket 812. The leg 804 may slide downward until the posts 836 reach the lowermost position in slots 838, at which point the leg 804 may be pivoted to fold underneath the table.

FIG. 4 depicts an exploded view of an embodiment of a play surface 106, which comprises four play surface plates 108. Play surface plates 108 may be configured to fasten to table top 104 using lock 402. Lock 402 may be configured to engage inner recesses 404 and fasten each plate 108 onto pedestal 118 (see FIG. 2.1). In some embodiments lock 402 may be a threaded rod with a handle, which may be received within a corresponding threaded opening in the pedestal 118. In addition, as shown in FIG. 2.1, table top 104 may include in each corner a tab 115 that fits over the top of an outer recess 406 of plate 108, and perimeter shelves 119 on which the ends of the plates 108 may rest. As shown in the configuration of FIG. 4, each play surface plate 108 may include a plurality of building surfaces 408 (e.g., posts) and a track 410. Thus, a user may assemble the play surface plates 108 into the configuration shown in FIG. 1.1 to use as a construction surface and play surface that can accommodate construction blocks and vehicles, for example.

Although embodiments disclosed herein relate to folding children's play tables, one of ordinary skill in the art would appreciate that the table top construction and folding leg construction of the present invention could be applied to any number of standing structures, such as kitchen tables, dining room tables, picnic tables, desks, and chairs. Therefore, notwithstanding the particular benefits associated with using the present invention with children's play tables, the present invention should be considered broadly applicable to any structure with folding members, such as legs.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A table comprising:

a table top;

a plurality of legs connected to the table top; and a plurality of removable play surface plates, wherein the table top has a recessed portion defined by a plurality of side walls and a recessed portion base surface, wherein the table top has a pedestal that protrudes from the recessed portion base surface and is separated from each of the plurality of side walls, wherein each of the plurality of removable play surface plates has a first end portion that rests on the pedestal, a second end portion that rests on a shelf defined by a side wall of the plurality of side walls, and a middle portion between the first end portion and the second end portion, which spans the recessed portion separated from the recessed portion base surface, wherein each second end portion of each of the plurality of removable play surface plates is disposed between the shelf and a tab defined by the side wall of the plurality of side walls, wherein the pedestal includes a lock that fastens each first end portion of each of the plurality of removable play surface plates to the table top, wherein the first end portion comprises an inner recess of the each removable play surface plate and the second end portion comprises an outer recess of the each removable play surface plate, wherein the lock engages the inner recess, and wherein the tab engages the outer recess.

2. The table of claim 1, wherein the plurality of side walls comprises four side walls, wherein the plurality of removable play surface plates comprises four removable play surface plates, wherein the first end portion of each of the plurality of removable play surface plates comprises a first corner, and wherein the second end portion of each of the plurality of removable play surface plates comprises a second corner.

3. The table of claim 2, wherein the tab comprises a tab that spans a corner between two side walls of the plurality of side walls.

4. The table of claim 1, wherein the plurality of side walls define continuous perimeter shelves around the recessed portion, wherein the shelf is part of the continuous perimeter shelves, and wherein the plurality of side walls rest on the continuous perimeter shelves.

5. The table of claim 1, wherein the pedestal is disposed at a central portion of the table top when the table top is viewed from a top plan view.

6. The table of claim 1, wherein the lock comprises a rod portion and a handle portion, and wherein the pedestal defines an opening that receives the rod portion of the lock.

7. The table of claim 6, wherein the rod portion and the opening are threaded.

8. The table of claim 1, wherein the table top comprises four side walls, wherein the table top includes a socket at each corner of the table top, wherein each socket protrudes from a respective outer side of the table top, wherein each socket receives a head portion of a leg of the plurality of the legs, wherein the head portion rotates within the socket along a radial direction such that the leg is rotatable within the each socket from a storage position under the table top to an operational position, and wherein an extension portion of the leg extends from the head portion and is angled outwardly with respect to the radial direction such that, in the operational position, the extension portion of the leg extends farther outwardly beyond the table top than if the extension portion were parallel to the radial direction.

9. The table of claim 1, wherein each of the plurality of removable play surface plates has a plurality of building posts configured to receive toy construction blocks.

10. A foldable table comprising:

a table top defining an outer perimeter when viewed from a top plan view, wherein when viewed from the top plan view, the table top comprises a first side, a second side opposite to the first side, a third side extending from the first side to the second side, a fourth side opposite to the third side and extending from the first side to the second side, a first socket disposed on the first side, wherein the first socket defines a first rotational axis and a first radial direction that is radial to the first rotational axis, a second socket disposed on the first side, wherein the second socket defines a second rotational axis and a second radial direction that is radial to the second rotational axis, a third socket disposed on the second side, wherein the third socket defines a third rotational axis and a third radial direction that is radial to the third rotational axis, a fourth socket disposed on the second side, wherein the fourth socket defines a fourth rotational axis and a fourth radial direction that is radial to the fourth rotational axis, wherein the first radial direction and the second radial direction diverge from each other in a direction away from the table top and converge in a direction toward the second side, and wherein the third radial direction and the fourth radial direction diverge from each other in a direction away from the table top and converge in a direction toward the first side; and a leg attached to each of the first, second, third, and fourth sockets, wherein the leg comprises a head portion and an extension portion, wherein the head portion rotates around the rotational axis, and along the radial direction, of the respective socket, from a folded position to an extended position, wherein, in both the folded position and the extended position, the radial directions along which the head portions of the legs of the first socket and the second socket rotate, diverge from each other in a direction away from the table top, wherein, in both the folded position and the extended position, the radial directions along which the head portions of the legs of the third socket and the fourth socket rotate, diverge from each other in a direction away from the table top, wherein, in the folded position, the extension portion is contained within the outer perimeter of the table top in the plan view, wherein, in the extended position, the extension portion extends beyond the outer perimeter of the table top in the respective radial direction in the plan view, wherein the table top defines a recessed storage compartment that is recessed with respect to a top surface of the table top and that extends longitudinally adjacent to the third side of the table top in a direction from the first socket toward the second side of the table top, wherein, at a bottom side of the table top, the recessed storage compartment has an outer side wall substantially parallel to the third side, an inner side wall substantially parallel to the third side, and a horizontal undersurface extending between the outer side wall and the inner side wall, wherein the extension portion of the leg attached to the first socket defines a longitudinal hollow cavity, and wherein in the folded position the recessed storage compartment of the table top is disposed within the hollow cavity of the extension portion of the leg attached to the first socket such that the extension portion of the leg attached to the first socket is disposed over the outer side wall, the inner side wall, and the horizontal undersurface of the recessed storage compartment.

11. The foldable table of claim 10, wherein the extension portion of the leg attached to the first socket includes an inner side, an outer side, and a transverse side extending between the inner side and the outer side, wherein the inner side, the transverse side, and the outer side provide an open construction defining the hollow cavity, and wherein in the folded position the outer wall is disposed opposing the outer side wall of the recessed storage compartment, the inner wall is disposed opposing the inner side wall of the recessed storage compartment, and the transverse wall is disposed opposing the horizontal undersurface of the recessed storage compartment.

12. The foldable table of claim 11, wherein, at the bottom side of the table top, the table top, the table top defines a first channel at the third side between an outside wall of the table top and the recessed storage compartment and a second channel between the recessed storage compartment and an adjacent central recessed storage compartment, wherein the first and second channels extend in a direction from the first side toward the second side, and wherein in the folded position the outer side of the extension portion of the leg attached to the first socket is disposed inside the first channel and the inner side of the extension portion of the leg attached to the first socket is disposed inside the second channel.

13. The foldable table of claim 11, wherein the outer side of the extension portion of the leg attached to the first socket is wider than the inner side of the extension portion of the leg attached to the first socket.

14. The foldable table of claim 12, wherein the outer side of the extension portion of the leg attached to the first socket is wider than the inner side of the extension portion of the leg attached to the first socket, and wherein the first channel is deeper than the second channel.

15. The foldable table of claim 10, wherein the extension portion of the leg attached to the first socket is angled outwardly with respect to the radial direction such that, in the extended position, the extension portion of the leg attached to the first socket extends farther outwardly beyond the table top than if the extension portion were parallel to the radial direction.

16. The foldable table of claim 10, wherein the first socket has a slot in which a post of the head portion of the leg attached to the first socket is slidably disposed, and wherein the post slides from an uppermost position in the slot at which the leg attached to the first socket cannot be folded parallel to the horizontal undersurface of the recessed storage compartment, to a lowermost position in the slot at which the leg attached to the first socket can be folded substantially parallel to the horizontal undersurface of the recessed storage compartment.

17. The foldable table of claim 10, wherein the first radial direction is substantially parallel to the third radial direction and the second radial direction is substantially parallel to the fourth radial direction.

18. A foldable table comprising:

a table top defining an outer perimeter when viewed from a top plan view, wherein when viewed from the top plan view, the table top comprises a first side, a second side opposite to the first side, a third side extending from the first side to the second side, a fourth side opposite to the third side and extending from the first side to the second side, a first socket disposed on the first side and adjacent to the third side, wherein the first socket defines a first rotational axis and a first radial direction that is radial to the first rotational axis, a second socket disposed on the first side and adjacent to the fourth side, wherein the second socket defines a second rotational axis and a second radial direction that is radial to the second rotational axis, a third socket disposed on the second side and adjacent to the third side, wherein the third socket defines a third rotational axis and a third radial direction that is radial to the third rotational axis, a fourth socket disposed on the second side and adjacent to the fourth side, wherein the fourth socket defines a fourth rotational axis and a fourth radial direction that is radial to the fourth rotational axis, wherein the first radial direction and the second radial direction diverge from each other in a direction away from the table top and converge in a direction toward the second side, and wherein the third radial direction and the fourth radial direction diverge from each other in a direction away from the table top and converge in a direction toward the first side; and a leg attached to each of the first, second, third, and fourth sockets, wherein the leg comprises a head portion and an extension portion, wherein the head portion rotates around the rotational axis, and along the radial direction, of the respective socket, from a folded position to an extended position, wherein, in both the folded position and the extended position, the radial directions along which the head portions of the legs of the first socket and the second socket rotate, diverge from each other in a direction away from the table top, wherein, in both the folded position and the extended position, the radial directions along which the head portions of the legs of the third socket and the fourth socket rotate, diverge from each other in a direction away from the table top, wherein when viewed in the plan view the first side and the second side extend generally in a vertical Y-direction and are opposite each other in a horizontal X-direction, and the third side and the fourth side extend generally in the horizontal X-direction, wherein the extension portion of the leg is angled outwardly with respect to the radial direction such that, in the folded position, the extension portion extends generally in the horizontal X-direction and is contained within the outer perimeter of the table top in the plan view, and such that, in the extended position, the extension portion extends beyond the outer perimeter of the table top in the respective radial direction in the plan view and a distal portion of the leg extends farther outwardly from the table top than if the extension portion were parallel to the head portion.

19. The foldable table of claim 18, wherein, in the folded position, the extension portion of the leg extends adjacent to and substantially parallel to its respective third or fourth side.

20. The foldable table of claim 19, wherein the first radial direction is substantially parallel to the third radial direction and the second radial direction is substantially parallel to the fourth radial direction.

* * * * *